United States Patent [19]

Harrison

[11] Patent Number: 4,550,855

[45] Date of Patent: Nov. 5, 1985

[54] MOIST TISSUE SOFT PACK DISPENSERS

[75] Inventor: Thomas S. Harrison, Deer Isle, Me.

[73] Assignee: Sterling Drug Inc., New York, N.Y.

[21] Appl. No.: 528,752

[22] Filed: Sep. 14, 1983

[51] Int. Cl.[4] ..... B65H 1/00

[52] U.S. Cl. ..... 221/63; 206/210; 383/86

[58] Field of Search ..... 206/210, 205; 383/84, 383/86; 221/47, 48, 63

[56] References Cited

U.S. PATENT DOCUMENTS

| | | | |
|---|---|---|---|
| 3,862,703 | 1/1975 | Dutcher . | |
| 4,002,264 | 1/1977 | Marchesani . | |
| 4,131,195 | 12/1978 | Worrell . | |
| 4,156,493 | 5/1979 | Julius . | |
| 4,185,754 | 1/1980 | Julius . | |
| 4,189,050 | 2/1980 | Jensen et al. | 383/84 |
| 4,192,420 | 3/1980 | Worrell . | |
| 4,252,238 | 2/1981 | Spiegelberg et al. . | |
| 4,260,061 | 4/1981 | Jacobs | 383/86 |
| 4,276,982 | 7/1981 | Sibrava et al. | 383/84 |
| 4,428,477 | 1/1984 | Cristofolo | 206/210 |

FOREIGN PATENT DOCUMENTS

| | | | |
|---|---|---|---|
| 1380727 | 1/1975 | United Kingdom | 383/84 |

*Primary Examiner*—H. Grant Skaggs
*Attorney, Agent, or Firm*—William G. Webb; B. Woodrow Wyatt; Paul E. Dupont

[57] ABSTRACT

This invention relates to compact, easily transportable, moist tissue or towelette dispensers which are so designed that they maintain the tissues contained within the dispenser in moist condition for exceptionally long periods of time, thus providing long shelf life for merchants, who stock the dispensers, as well as a long life span of the dispensers for the consumer.

8 Claims, 5 Drawing Figures

MOIST TISSUE SOFT PACK DISPENSERS

BACKGROUND

This invention relates to the field of dispensing packages for moist tissues or towelettes which are used for freshening or cleaning up the skin when soap and water are not available. More specifically, the invention relates to soft pack moist towelette dispensers of the type that might be stored in one's home or which might be carried, for example, either on one's person, in a lady's pocketbook, in a mother's diaper bag, in the glove compartment of automobiles or in picnic basket kits.

INFORMATION DISCLOSURE STATEMENT

Dutcher U.S. Pat. No. 3,862,703 discloses a package for dispensing dampened or liquid impregnated cleansing tissues which may be reclosed when not in use. The dispenser has a weakened section on the top panel which, when broken away, forms a hole. Attached to the top panel is a hinged section forming a plug supporting panel, on the bottom surface of which is attached a plug which fits within, and closes off, the hole in the top.

Marchesani U.S. Pat. No. 4,002,264 discloses a flexible pouch type dispenser for moist tissues comprising a flexible pouch holding a coreless roll of moist tissues which is fitted with a restricted opening 18 through which the tissues can be withdrawn. The restricted opening provides sufficient "drag" so that the tissues can be "snapped off" at perforated lines between the tissues as they are drawn through the opening. The bag also is equipped with a reclosable sealing means 16, which, although not specifically described, appears, from the drawings, to be of the well known "zip-lock" type.

Worrel U.S. Pat. No. 4,131,195 discloses a flexible moisture-impervious package for storing and dispensing a stack of premoistened sheets. The package consists of a dispenser section or "pocket portion" composed of a top and a bottom wall, sealed together to form a pocket for holding the stack of sheets, the bottom sheet having an extended length to provide a flap which can be folded over the top of the dispenser section. The top wall has a dispensing hole or opening 22, and the sheets, which are C-folded, present two edges through the hole for gripping and withdrawal of the sheets. In a preferred embodiment shown in FIGS. 1 and 2, the pocket is sealed by providing a moisture-impervious protective sheet 26 which covers opening 22. The protective sheet is releasably secured to the top wall of the dispenser section and, presumably just before use, is removed therefrom. Thereafter the flap is sealed over the dispensing opening by providing a pressure sensitive adhesive 28 on the top surface of the pocket. However, because of the size of the hole and the placement of the pressure sensitive adhesive 28, the closure flap cannot completely seal the package contents to prevent evaporation of moisture from the tissues contained therein once the protective sheet is removed.

Julius U.S. Pat. No. 4,156,493 and c.i.p. thereof U.S. Pat. No. 4,185,754 disclose flexible packages for dispensing moisture impregnated towelettes or wipes. In one embodiment shown in FIG. 1B, a package is depicted having a generally oval-shaped opening 7′ for withdrawing towelettes, the opening being closed by a closure flap 22 which is sealed to the package at one end to form a hinge 21. The flap is coated with an adhesive coating 24 which seals the flap over the opening when the dispenser is not in use. Towelettes are dispensed by lifting the closure flap and withdrawing towelettes through the opening 7′. In a somewhat similar embodiment shown in FIG. 5A, the flexible package is formed by folding the flexible package material over the towelettes to be dispensed, so as to overlap the edges of the package material and form an overlapping closure flap 57. The ends 51/52 of the folded package are then sealed, for example by heat sealing. An adhesive layer 56 is placed on the outside of the package beneath the flap 57 so as to provide means for sealing the dispensing opening provided by the overlapped edges.

Worrell U.S. Pat. No. 4,192,420 disclose a flexible pouch like package for dispensing premoistened towelettes. The package is composed of a pouch, the top and bottom walls of which are formed of a polypropylene/polyethylene laminate, the edges of the two walls being heat sealed together. The top wall has a weakened region 32 defined by a perforated score line. A flap portion 12 is sealed at its margin 38 to the top wall along one edge and is coated with an adhesive layer 40. Thus when the flap portion is closed over the top wall, it seals to the latter, and when the flap portion is lifted up by grasping a tab 53, the flap peels back along score lines 42/44 leaving guiding sections 50/52 still sealed to the top wall. At the same time, a plug section 34, which is adhered to the flap, is formed by severance along weakened score lines defining the weakened region 32. The top layer of the premoistened towelettes within the pouch is thus exposed, and the towelette at the top of the stack can be withdrawn through the opening produced by removal of the plug.

Spiegelberg et al. U.S. Pat. No. 4,252,238 discloses pouch like packages for dispensing premoistened towelettes. The pouches, each formed from a single sheet of plastic material and heat sealed along the edges, are generally T-shaped in cross section, the head of the "T" forming the pouch for containing the towelettes and the stem of the "T" forming the opening through which the towelettes are withdrawn. The pouches are sealed after withdrawal of a towelette either by providing a flap extension 11 which folds over the opening at the end of the "T" stem section, as in FIGS. 1–3, or by providing a zip-lock type of closure, such as 13/14 shown in FIGS. 4 and 5 or 16/17 shown in FIGS. 6 and 7.

The effectiveness of moist towelette package dispensers in maintaining the towelettes in a moist condition over prolonged periods of time will depend in large measure either on the integrity of the package sealing means or on the physical design of the sealing means. Thus Dutcher, Marchesani and Spiegelberg depend, for their effectiveness, on particular design features, Dutcher depending on the effectiveness of the plug unit, and Marchesani and Spiegelberg depending for their effectiveness on a zip-lock closure. Worrell and Julius depend, in each instance, for their effectiveness on the integrity of pressure adhesive seals.

BRIEF DESCRIPTION OF THE INVENTION

Moist tissue towelette dispensing packages of the type provided by the present invention are generally used infrequently as occasion for their need arises. Thus, unless the package dispensers have a particularly effective method of sealing, once the dispensers are opened, the towelettes would tend to dry out and become useless in a short period of time. The dispensing packages of the present invention are not only easily opened for use, in addition they combine both an effective sealing means and a particular design feature to provide moist tissue dispensers which, even though opened for use, maintain the tissues in moist condition for an exceptionally long period of time. The packages thus not only are easily opened for use by the consumer, they also have a very long "shelf life" for merchants who stock the dispenser, and they have a long effective life span for the consumer.

More specifically, the present invention is directed to soft package dispensers for moist towelettes in which the towelettes are completely enclosed within a moisture-impervious envelope having a small opening for extraction of the towelettes contained within the package, the opening being positioned in a closure flap portion of the dispenser package and providing the only opening into the envelope. The opening is sealed over its entire dimensions, when the package is not in use, against a pressure sensitive adhesive area.

BRIEF DESCRIPTION OF THE DRAWINGS

The invention is described below with reference to the accompanying drawings wherein.

DETAILED DESCRIPTION OF THE INVENTION

The invention will now be described in detail with reference to the foregoing drawings wherein like numerals are used to identify like parts.

Figure 1:
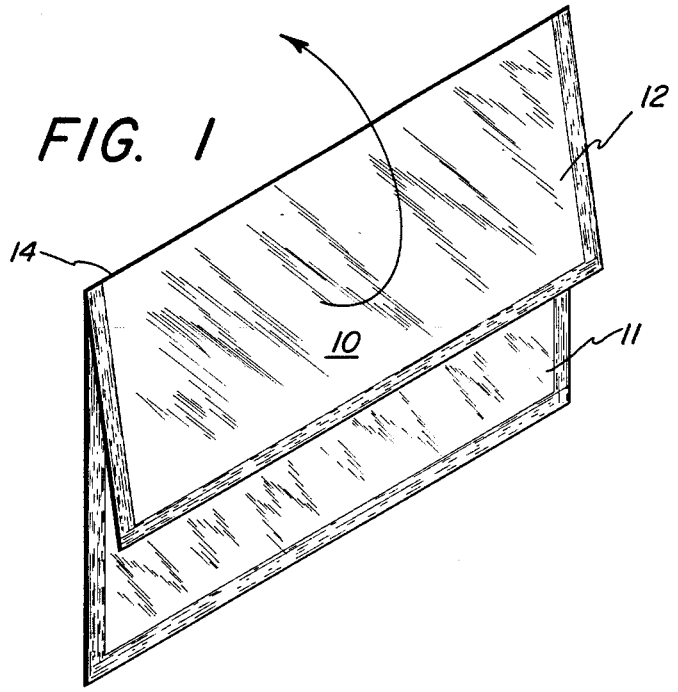
FIG. 1 is a perspective view of a dispensing package of the invention as it would appear in a closed, nonuse or storage configuration.

A preferred form of moist towelette dispensers provided by this invention is shown in FIG. 1 and is represented by general reference numeral 10. As there depicted, the preferred form has the general appearance of a lady's clutch purse and consists of two main sections or portions, a towelette holding section or portion 11 and a closure flap portion 12 which is opened by pivoting about transverse fold line 14 as indicated by the arrow.

Figure 2:
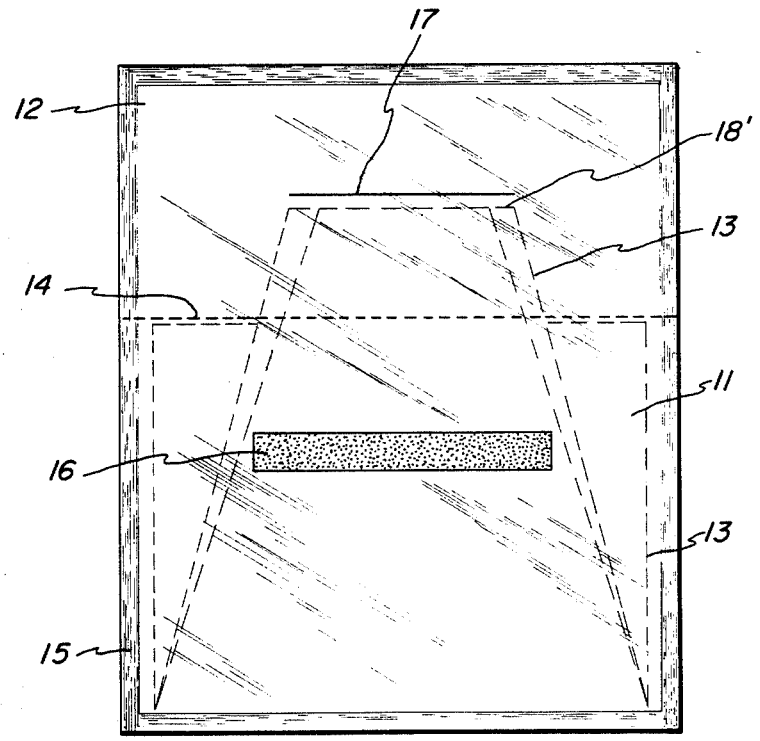
FIG. 2 is a top view of a package of the invention as it would appear, with a closure flap portion opened, in a use or dispensing configuration.

As shown in FIG. 2, a stack of moistened towelettes 13, shown in phanton, is carried within the towelette holding section 11 of dispenser 10. The flap portion 12, unitary with the towelette holding section, can be folded over, or unfolded from, the towelette holding section along transverse fold line 14 as previously indicated with reference to FIG. 1.

Figure 3:
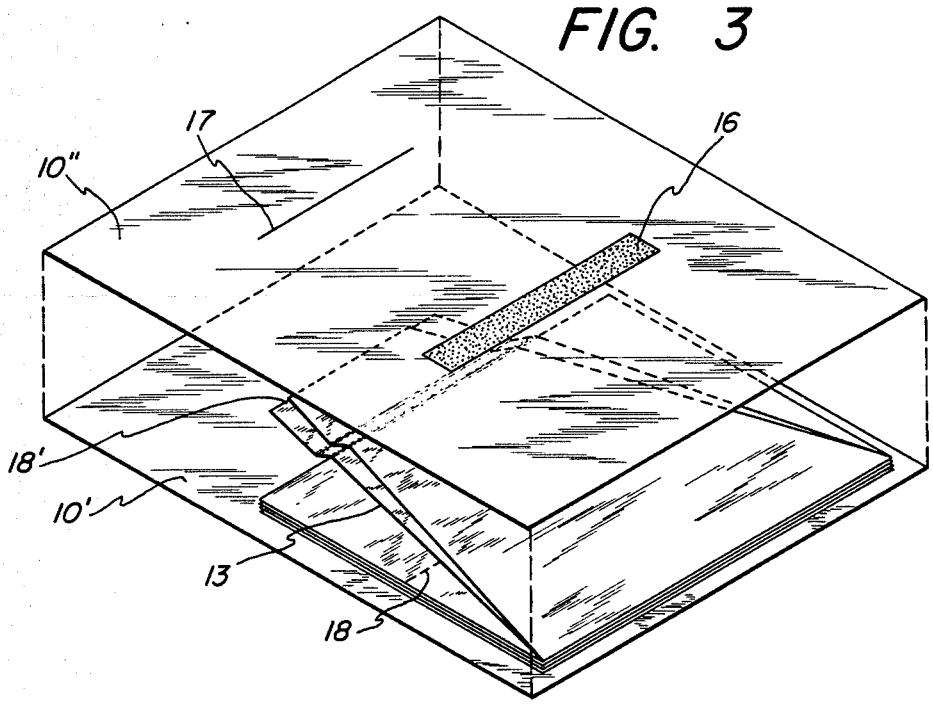
FIG. 3 is an exploded perspective view of a dispenser package of the invention and a folded towelette stack showing the method of assembly of the packages of the invention.
Figure 4:
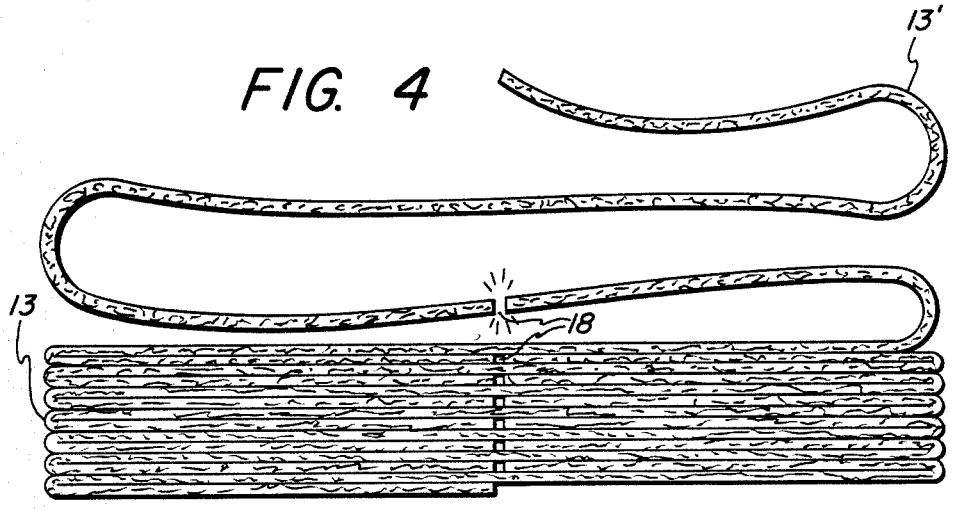
FIG. 4 is an end view of a stack of towelettes showing how the towelettes are folded before packaging within a dispenser package of the invention.

As shown in FIG. 3, the dispenser packages of the invention are composed of an upper and a lower sheet 10''/10' of flexible, moisture impervious material, the two sheet having the same overall outer dimensions. The upper and lower sheets, for example of polyethylene or polypropylene, are heat sealed to one another around all four outer edges, as shown by reference numeral 15 in FIG. 2, thus forming an envelope which encloses within a portion thereof a stack of premoistened towelettes 13. Before sealing the two sheets together, a supply of towelettes, depicted as a zig-zag folded stack thereof in FIGS. 3 and 4, is placed on the lower sheet 10' in a location corresponding to the towelette holding portion thereof, and the top fold of the stack is unfolded so that the end 18' would lie proximate dispensing slit 17 when the upper sheet is sealed over the lower sheet.

In the preferred embodiment shown in FIGS. 1, 2 and 3, the upper sheet 10'' of the pouch has a strip of adhesive 16 affixed to the surface of the sheet corresponding to the outside of the package and located generally on the towelette holding section. The strip, which in this embodiment is generally long and narrow in shape, is affixed to the sheet 10'' substantially parallel to fold line 14. The adhesive strip is formed of a material which is coated on both sides with adhesive materials. The adhesives are so-chosen that one side, having greater adhesive strength than the other, will be essentially permanently adhered to the dispenser pack, while the other side will provide a releasable adherence with the package material. Thus, in the configuration shown in the figures, the adhesive strip will be essentially permanently bonded to the upper sheet of the package over the towelette holding section but will permit opening of the flap portion from its sealing engagement with the upper, less adhesive side of the adhesive strip.

With reference to FIG. 2 again, the upper sheet also has a small opening in the form of a slit 17, generally parallel to strip 16, which is located the same lateral distance from the fold line 14 as the strip. Thus when the flap portion 12 is folded over the towelette holding portion 11 along fold line 14, the slit will fall directly over the adhesive strip, thereby completely sealing the interior of the package from the atmosphere and preventing evaporation of the moisture from the towelettes within the package.

From the above description of the dispenser packages of the invention, it will be readily apparent that the dispensers utilize two separate design features to effectively seal the package contents from evaporation, namely the complete sealing of the dispenser opening with the adhesive seal when the package is not in use and the folding of the flap portion, in which the dispensing opening is located, at fold line 14 over the towelette holding portion, the crease formed at the fold line thus forming a secondary seal. This double seal can obviously only be obtained by location of the dispensing opening in the flap portion.

In order to sequentially dispense the folded towelettes one at a time from the package in the preferred embodiment here-described, the towelettes are folded in a zig-zag overlaid pattern as shown in FIG. 4, and each individual towelette is defined by a transverse row of perforations indicated by 18 in FIGS. 3 and 4, which provides a severance line along which one towelette can be separated from the next. A completely separate towelette 13' which is severed at perforations 18 is shown in FIG. 4.

In between dispensing operations, the packages of the invention would be stored, carried on the person or transported, as the case may be, in the configuration shown in FIG. 1. When it is desired to remove a towelette from the package, the flap portion 12 is unfolded from its sealing engagement with the towelette holding portion 11. The user then reaches through the opening 17 and grasps the end of the top towelette of the stack, drawing it through the slit. When the towelette has been withdrawn to the point where the next line of perforations reaches a point near the slit, the user will detect a clearly perceptible resistance to further withdrawal of the towelette, owing perhaps to resistance to unfolding of the zig-zag folded stack. A sharp snap on the end of the tissue will then cause the towelette to separate from the stack leaving the end 18' of the next towelette in position near the slit for similar withdrawal as shown in FIG. 2. It will be seen from this description of the method of using the packages of the invention, together with the foregoing description of the construction of the dispenser packs, that the towelettes contained by the package are maintained at all times, until being dispensed, entirely within the moisture-impervious envelope, the only opening to which is completely and effectively sealed against the adhesive strip when the package is not in use. Thus there is no wicking effect caused by evaporation of the moisture from an exposed portion of the towelettes when the dispenser is not in use, and consequently the moist towelettes have an unusually long and indefinite life span.

Although a particularly preferred embodiment of the invention has been described above in order to better illustrate the same, it will be apparent that alternative structural features can be substituted for elements described herein without either departing from the spirit of the invention or in any way adversely affecting the operability of the same. Thus, for example, although the towelettes maintained within the package have been described herein as being arranged in a zig-zag folded stack, any means of dispensing the supply of towelettes one at a time from the dispenser would be operative and is considered to be within the purview of the invention. The supply of towelettes in the dispenser can thus comprise, for example, any continuous web of tissues, separated by perforations, including either a randomly packed supply or a coreless roll thereof, or a disconnected interleaved stack of tissues. The connected zig-zag stack depicted in the figures herein is a particularly preferred embodiment, because, as previously noted, that arrangement of the tissues provides a resistance to withdrawal of the tissues beyond the point indicated at 18' in FIG. 2 which automatically signals the user to snap off the tissue when such resistance is felt. This preferred embodiment, when used as described, will always leave the end of the next tissue in the web entirely within the envelope package, a feature that is essential to the effective functioning of the packages of the invention. With other contemplated embodiments, it may be necessary for the user to grasp the package and supply of tissues when a tissue is disconnected from the supply so as to insure that the end of the next tissue remains inside the envelope.

Moreover, although the opening 17 for withdrawal of the moist towelettes has been described above as a slit generally parallel to the fold line, it is contemplated that any relatively small opening of any suitable configuration can be used for dispensing the towelettes, including a round or oval hole or a narrow slit at any convenient angle to the fold line 14, including being perpendicular thereto. It is critical that the opening be of such size that the user can insert his fingers through the opening to grasp a tissue for withdrawal through the opening.

Figure 5:
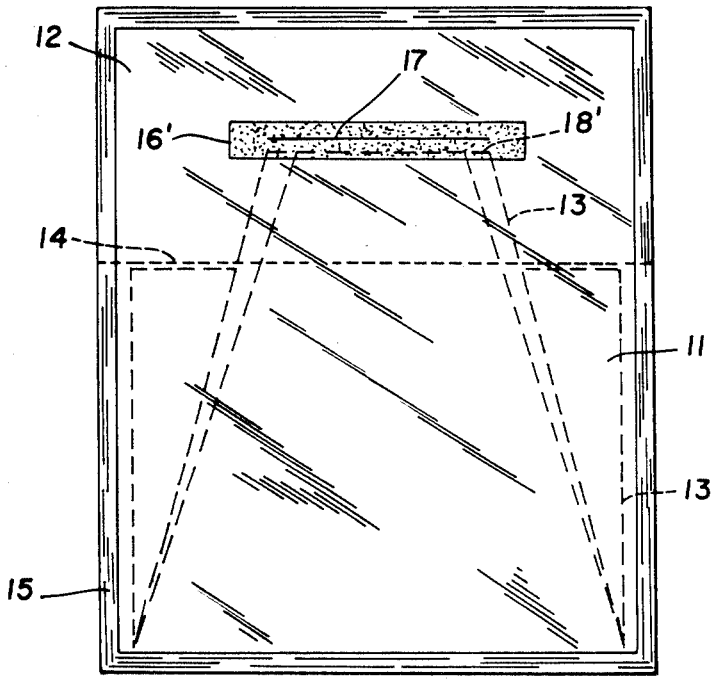
FIG. 5 is a top view of a package of a second embodiment of the invention with a closure flap portion opened in use or dispensing configuration.

It is also critical that the adhesive area be so-positioned on the upper sheet of the dispenser package and be so-dimensioned and so-configured that it will seal the opening in the flap portion against the tissue holding section. Therefore although, for purposes of illustration, the adhesive area has been described herein as being located on the tissue dispensing section at a point generally equidistant with the opening from the fold line, it will be understood that the adhesive area can also be positioned on the flap section so that it surrounds the dispensing opening as indicated by the adhesive area 16' shown in FIG. 5. It will be clear that either alternative location of the adhesive area will effectively seal the dispensing opening, and both alternative locations of the adhesive area are considered to be within the purview of the invention.

A preferred size of opening 17 is one whose length or width corresponds to about one third to about the width of the towelettes measured along the line of perforations. A particularly perferred dimension for the length of a slit, as depicted in FIGS. 1, 2 and 3, is about one half the width of the towelettes.

It will also be appreciated that the dispensers provided by this invention, unlike those provided by the prior art, are of very simple construction and are fabricated of relatively simple and inexpensive materials. The simplicity of the packages, coupled with their unusual effectiveness in maintaining the towelettes in moist condition for long periods of time, thus provide a substantial advance in the art of moist towelette dispensers.

Having thus described the invention and the advantages thereof, it is considered that the invention is to be broadly construed and limited only by the character of the following claims.

I claim:

1. A moist towelette dispenser package containing a supply of moist towelettes in a continuous zig-zag folded web and separated by perforations, wherein said package comprises an envelope having a towelette holding portion and a closure flap portion separated from one another by a transverse fold line, said envelope being formed from an upper and a lower sheet of flexible, moisture-impervious material, said sheets being of the same overall outer dimensions and sealed to one another around the outer edges thereof, said upper sheet having an adhesive area affixed thereto, said upper sheet being further provided with a dispensing opening positioned on said flap portion, said dispensing opening and adhesive area being located generally equidistant from said fold line so that when said flap portion is folded over said towelette holding portion along said fold line, said opening is completely sealed by said adhesive area against said towelette holding portion and wherein said perforations in said folded web serve to provide means for separation of each towelette from the supply thereof so that, on withdrawal and separation of each towelette, the end of the next towelette in said web is left entirely within said envelope package.

2. A moist towelette dispensing package according to claim 1 wherein said dispensing opening comprises a slit, said adhesive area comprising a strip, and said adhesive area is affixed to said towelette holding portion so that, when said flap portion is folded over said towelette holding portion, said slit falls directly over, and is sealed by, said adhesive area.

3. A moist towelette dispenser package according to claim 2 wherein both said slit and said strip are parallel to said fold line.

4. A moist towelette dispenser package according to claim 3 wherein the length of said slit corresponds to about one third to about the width of said sheets.

5. A moist towelette dispenser package according to claim 4 wherein said sheets are heat sealed around the outer edges thereof.

6. A moist towelette dispenser package according to claim 2 wherein the length of said slit corresponds to about one third to about the width of said towelettes.

7. A moist towelette dispenser package according to claim 6 wherein said sheets are heat sealed around the outer edges thereof.

8. A moist towelette dispenser package according to claim 1 wherein said dispensing opening comprises a slit, said adhesive area comprises a strip, and said adhesive area is affixed to said flap portion and surrounds said slit so that, when said flap portion is folded over said towelette holding portion, said slit is sealed against said towelette holding portion by said adhesive area.

* * * * *

UNITED STATES PATENT AND TRADEMARK OFFICE

CERTIFICATE OF CORRECTION

PATENT NO. : 4,550,855

DATED : November 5, 1985

INVENTOR(S) : Thomas S. Harrison

It is certified that error appears in the above-identified patent and that said Letters Patent is hereby corrected as shown below:

Column 6, line 61, change "comprising" to read — comprises —.

Signed and Sealed this

*Fifteenth* Day of *April 1986*

[SEAL]

*Attest:*

DONALD J. QUIGG

*Attesting Officer*

*Commissioner of Patents and Trademarks*